US010962207B2

(12) United States Patent
Neal et al.

(10) Patent No.: US 10,962,207 B2
(45) Date of Patent: Mar. 30, 2021

(54) HUB FOR LIGHTING AT GRID INTERSECTION

(71) Applicant: Worthington Armstrong Venture, Malvern, PA (US)

(72) Inventors: Joshua L. Neal, Elverson, PA (US); Brett W. Sareyka, Glen Mills, PA (US)

(73) Assignee: WORTHINGTON ARMSTRONG VENTURE, Malvern, PA (US)

( * ) Notice: Subject to any disclaimer, the term of this patent is extended or adjusted under 35 U.S.C. 154(b) by 649 days.

(21) Appl. No.: 15/495,191

(22) Filed: Apr. 24, 2017

(65) Prior Publication Data

US 2017/0307191 A1 Oct. 26, 2017

Related U.S. Application Data

(60) Provisional application No. 62/327,218, filed on Apr. 25, 2016.

(51) Int. Cl.
*E04B 9/18* (2006.01)
*F21V 21/04* (2006.01)
(Continued)

(52) U.S. Cl.
CPC ..... *F21V 21/048* (2013.01); *E04B 9/006* (2013.01); *F21S 8/026* (2013.01); *F21S 8/028* (2013.01);
(Continued)

(58) Field of Classification Search
CPC ..... E04B 9/006; E04B 9/122; E04B 9/127; E04B 9/068; E04B 9/18; F21S 8/026; F21V 21/048
See application file for complete search history.

(56) References Cited

U.S. PATENT DOCUMENTS 3,511,012 A * 5/1970 Brady ..... E04B 9/122 52/667
4,015,811 A * 4/1977 Nute, Jr. ..... E04B 9/18 248/343
(Continued)

FOREIGN PATENT DOCUMENTS

DE 3500258 7/1986
DE 3907755 9/1990
(Continued)

OTHER PUBLICATIONS

International Search Report by the European Patent Office for International Application No. PCT/US2017/029355 dated Jul. 10, 2017.

*Primary Examiner* — Brent W Herring
*Assistant Examiner* — Daniel J Kenny
(74) *Attorney, Agent, or Firm* — Stradley Ronon Stevens & Young, LLP

(57) ABSTRACT

A hub for lighting at a grid intersection. The hub includes a light enclosure, light fixture, yoke, clip adapter, and beams. The enclosure includes connected walls each having a central offset portion with a connecting slot and multiple fixture slots. The yoke includes a middle section, two side sections, and two connector sections having protrusions. The yoke is attached to the enclosure by passing the connector sections through the connecting slots in opposite walls of the enclosure. Clips are inserted into the connecting slots that do not contain the yoke. The clips include arms extended therefrom and have protrusions. Beams with end adapters having holes are then connected to the enclosure by engaging the protrusions on the yoke and clips with the holes on the clip adapters. A light fixture can then be attached with fasteners passing through the fixture and slots in the fixture. Optionally a driver can be attached to the fixture.

12 Claims, 15 Drawing Sheets

(51) Int. Cl.

| | |
|---|---|
| ***E04B 9/00*** | (2006.01) |
| ***F21S 8/02*** | (2006.01) |
| *E04B 9/14* | (2006.01) |
| *F21Y 115/10* | (2016.01) |

(52) U.S. Cl.
CPC ..... *F21V 21/049* (2013.01); *E04B 9/14* (2013.01); *F21Y 2115/10* (2016.08)

(56) References Cited

U.S. PATENT DOCUMENTS

D248,013 S * 5/1978 Win ..... D8/373
4,723,749 A * 2/1988 Carraro ..... E04B 9/18 24/336
5,839,246 A 11/1998 Ziegler et al.
6,178,712 B1 * 1/2001 Sauer ..... E04B 9/122 52/506.06
6,345,800 B1 * 2/2002 Herst ..... E04B 9/006 248/342
6,761,341 B2 * 7/2004 Pfaller ..... H02G 3/125 248/200.1
7,255,315 B2 * 8/2007 Oh ..... F16L 3/24 248/342
7,255,375 B2 * 8/2007 Heid ..... E05B 15/0006 292/112
7,552,567 B2 * 6/2009 Ingratta ..... E04B 9/06 52/506.05
7,735,794 B1 * 6/2010 Gretz ..... E04B 9/006 248/200.1
8,297,579 B1 * 10/2012 Gretz ..... H02G 3/125 220/3.9
8,615,947 B2 12/2013 Underkofler et al.
8,720,147 B2 * 5/2014 Roman ..... E04B 9/18 52/506.07
8,839,583 B2 * 9/2014 Sareyka ..... E04B 9/122 52/506.05
9,115,488 B2 * 8/2015 Jankovec ..... E04B 9/127
D763,606 S * 8/2016 Benecke ..... D6/678.1
9,416,535 B1 * 8/2016 Yaphe ..... E04B 9/006
9,899,817 B2 * 2/2018 Korcz ..... F16M 13/027
10,047,936 B2 * 8/2018 Sareyka ..... E04B 9/068
10,082,279 B2 * 9/2018 Jones ..... F21V 21/048
10,426,985 B2 * 10/2019 Beagen ..... E04B 9/14
2004/0035071 A1 2/2004 Ho et al.
2012/0186175 A1 7/2012 Gerkes et al.
2013/0318905 A1 * 12/2013 Underkofler ..... E04B 9/18 52/506.06
2015/0377386 A1 * 12/2015 Mitchell ..... F16L 3/245 169/51
2017/0362828 A1 * 12/2017 Czyzewicz ..... E04B 9/006

FOREIGN PATENT DOCUMENTS

| | | |
|---|---|---|
| DE | 4430292 | 2/1996 |
| EP | 2236687 | 10/2010 |
| JP | 449354 | 2/1992 |
| WO | 00/63505 | 10/2000 |

* cited by examiner

HUB FOR LIGHTING AT GRID INTERSECTION

RELATED APPLICATION

This application claims the benefit of priority to U.S. Provisional Patent Application Ser. No. 62/327,218, filed on Apr. 25, 2016, the contents of which are incorporated in this application by reference.

FIELD OF THE INVENTION

The invention relates generally to a suspended ceiling system. More particularly, the invention relates to a hub for installing a lighting fixture at the intersection of two beams of a suspended ceiling system.

BACKGROUND OF THE DISCLOSURE

Suspended ceilings having a metal grid framework which supports panels of acoustical tile are used extensively in commercial and industrial buildings. It is often desirable to incorporate recessed lighting into a suspended ceiling. To avoid interrupting the grid framework, recessed lighting is generally installed between beams of the metal grid framework (i.e., in the middle of an acoustical tile). Locating the recessed lighting between the beams requires extensive framework to support the light fixture, however, and results in an architecturally undesirable interruption in the appearance of the suspended ceiling.

It is therefore desirable to provide a system for positioning the light fixture at the intersection of beams of the metal grid framework which allows for seamless integration of the light fixture into the grid framework and simplifies installation.

SUMMARY OF THE INVENTION

To achieve this and other desires, and in view of its purposes, the present invention provides a hub for lighting at a grid intersection. The hub includes four connected walls defining an interior space. Each wall has a wall surface with an outwardly projected wall protuberance having a first aperture, and at least one second aperture within the wall surface. The hub further includes a yoke having a middle section and two connector sections. The middle section of the yoke connects two side sections each having a louver element and a protruding edge. Each of the two connector sections has a connector section edge connected to one side section and include a connector leading edge opposite the connector section edge, a first side in contact with the connector leading edge and the side section having a flange and a yoke stop, and a second side that is opposite the first side and has a notch and at least one yoke protrusion. The yoke is releaseably connected to the walls by the connector leading edge passing through the first apertures of walls opposite one another.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

When referring to the drawing, like reference numbers refer to like elements throughout the various figures that comprise the drawing.

DETAILED DESCRIPTION

Figure 1A:
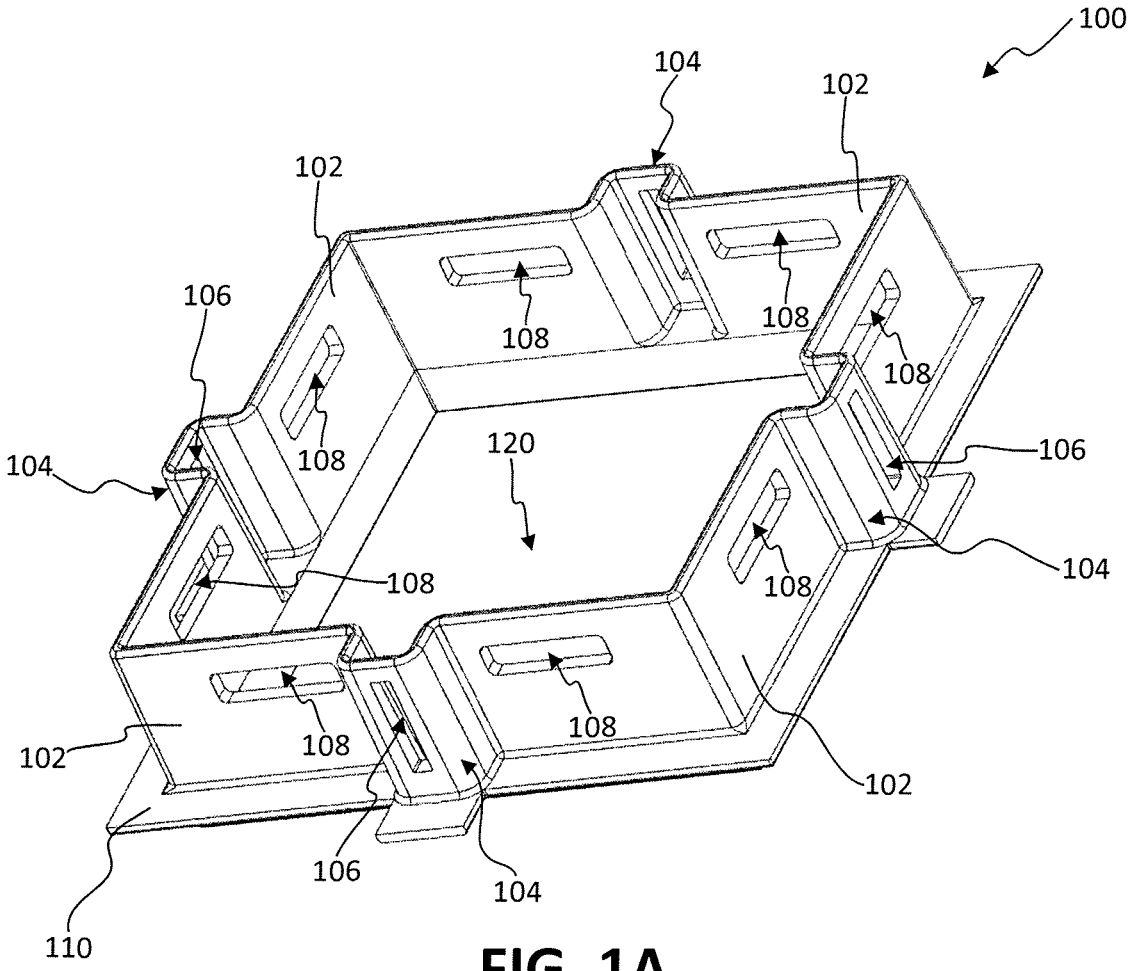
FIG. 1A is a perspective view of a lighting hub, according to an embodiment of the invention.

The features and benefits of the disclosure are illustrated and described by reference to exemplary embodiments. The disclosure also includes the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combination of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the figure under discussion. These relative terms are for convenience of description only and do not require that the apparatus be construed or operated in a particular orientation. Terms such as "attached," "affixed," "connected," "coupled," "interconnected," and similar terms refer to a relationship wherein structures are secured or attached to one another either directly or indirectly through intervening structures, as well as both moveable or rigid attachments or relationships, unless expressly described otherwise.

Figure 1B:
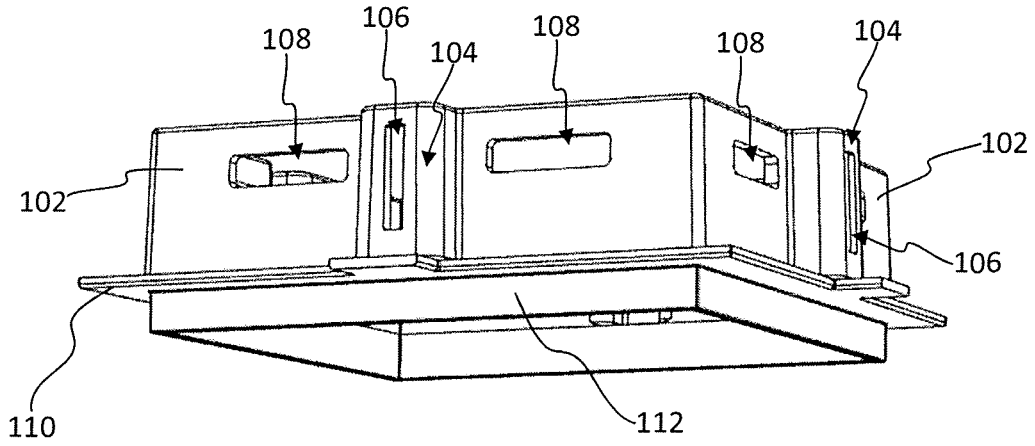
FIG. 1B is another perspective view of the lighting hub of FIG. 1A, according to an embodiment of the invention.

Referring to FIGS. 1A-1B, a lighting hub 100 is provided according to an embodiment of the invention. The lighting hub 100 includes four vertical walls 102 connected in a rectangle surrounding an interior 120. Preferably, the lighting hub 100 is square. Each vertical wall 102 includes an offset portion 104 at the center of the vertical wall 102. Each offset portion 104 includes a first aperture, which may be a vertical slot 106. The lighting hub 100 further includes a plurality of light attachment apertures 108, which may be slots. Each vertical wall 102 preferably includes at least one light attachment slot 108, and more preferably more than one light attachment slot 108. In some embodiments of the disclosure, the first aperture 106 and the attachment apertures 108 are located on different planes. The lighting hub 100 also includes a horizontal flange 110 and a vertical flange 112 extending from the bottom of each vertical wall 102. The horizontal flange 110 and the vertical flange 112 may have any suitable size and shape, for example to match the visual style of a suspended ceiling system used in conjunction with the lighting hub 100.

Figure 2A:
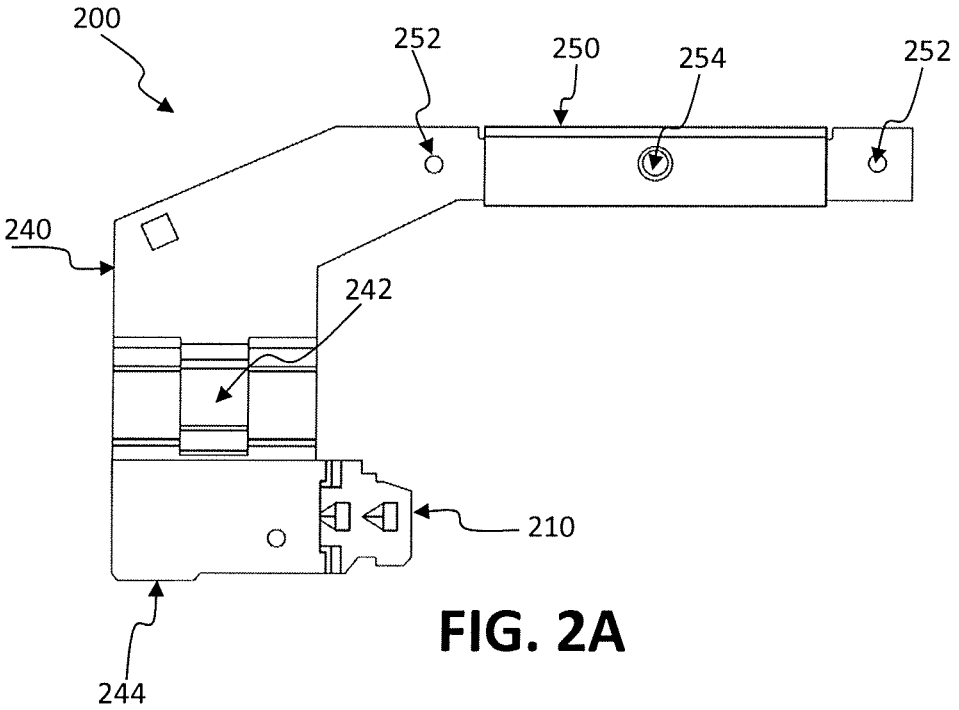
FIG. 2A is a side view of a yoke half, according to an embodiment of the invention.
Figure 2B:
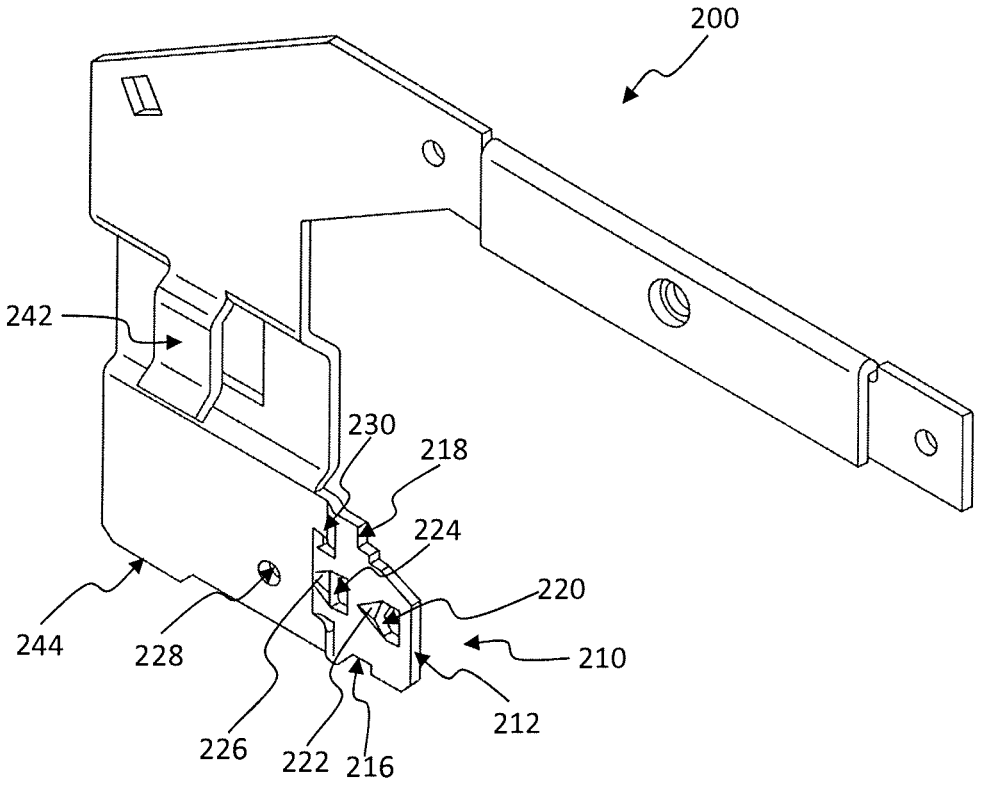
FIG. 2B is a perspective view of the yoke half of FIG. 2A, according to an embodiment of the invention.

Referring to FIGS. 2A and 2B, a yoke half 200 is provided according to an embodiment of the present invention. Each yoke half 200 includes a connector portion 210, a vertically extending side portion 240, and a horizontally extending middle portion 250 which extends back in the direction of a leading edge 212 of the connector portion 210. The horizontally extending middle portion 250 includes a plurality of joint holes 252 and a hanger hole 254. The length of the vertically extending side portion 240 may be varied in order to accommodate lighting fixtures of different shapes and heights. For example, the vertically extending side portion 240 may initially curve or bend outward to allow for adjustable lights which may not align vertically with the lighting hub 100.

In certain embodiments, the vertically extending side portion 240 includes stabilizing features. Such stabilizing features may include a louver element 242 and/or a protruding edge 244. The louver element 242 stabilizes the structure by contacting the top of a beam (described in more detail below), on both sides of the beam, such that the rotation of the lighting hub 100 around an axis of rotation, which is parallel or substantially parallel to the vertical walls 102, is restricted. The protruding edge 244 stabilizes the structure by contacting the flange of a beam (described in more detail below) such that the rotation of the lighting hub 100 around an axis of rotation, which is perpendicular or substantially perpendicular a vertical wall 102, which connector portion 210 of the yoke half 200 does not contact, is restricted.

The connector portion 210 of the yoke half 200 includes an upper flange 214 adjacent to the leading edge 212 and a notch 216 on the opposing side of the connector portion 210 from the upper flange 214. The notch 216 is aligned with a stop 218 on the same edge of the connector portion 210 as the upper flange 214. The yoke half 200 further includes two slots: a leading slot 220 nearer to the leading edge 212 and a trailing slot 224 farther from the leading edge 212. The leading slot 220 and the trailing slot 224 are partially punched out from the connector portion 210 so that there is a leading protrusion 222 and a trailing protrusion 226 adjacent to the leading slot 220 and the trailing slot 224, respectively. The leading protrusion 222 and the trailing protrusion 226 open toward the leading edge 212. The connector portion 210 may optionally include a rivet hole 228 behind (i.e., farther from the leading edge 212) the trailing protrusion 226. The connector portion 210 includes an offset 230 between the stop 218 and the vertically extending side portion 240. The upper flange 214, the leading slot 220, and the trailing slot 224 are between the leading edge 212 and the offset 230.

Figure 3A:
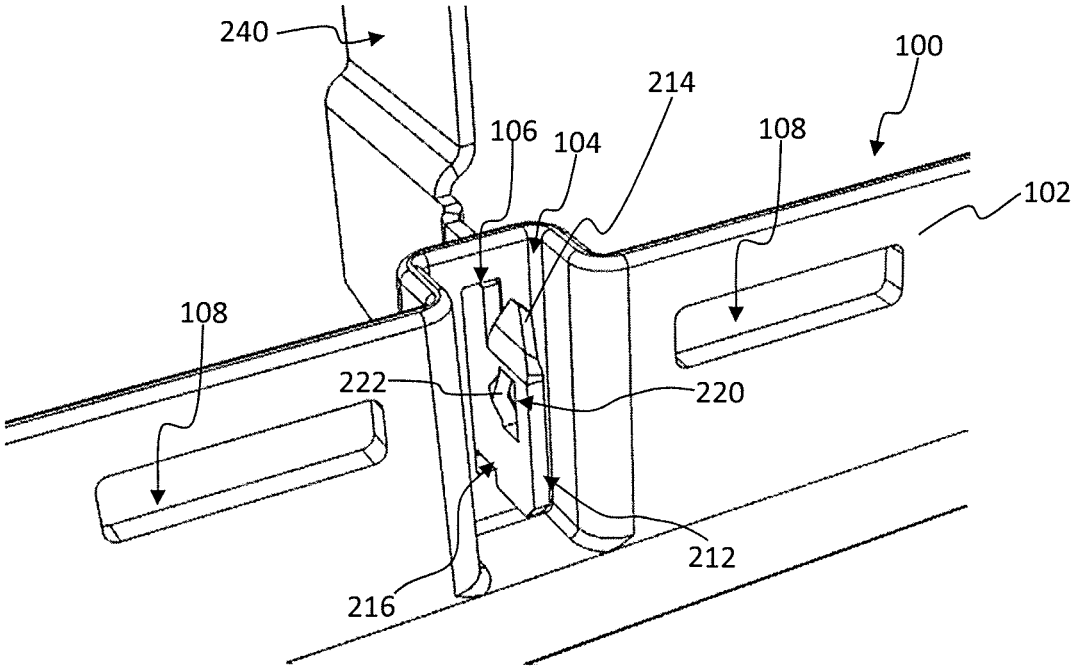
FIG. 3A is a perspective view of a yoke half, according to an embodiment of the invention, inserted into the lighting hub of FIGS. 1A and 1B, according to an embodiment of the invention.
Figure 3B:
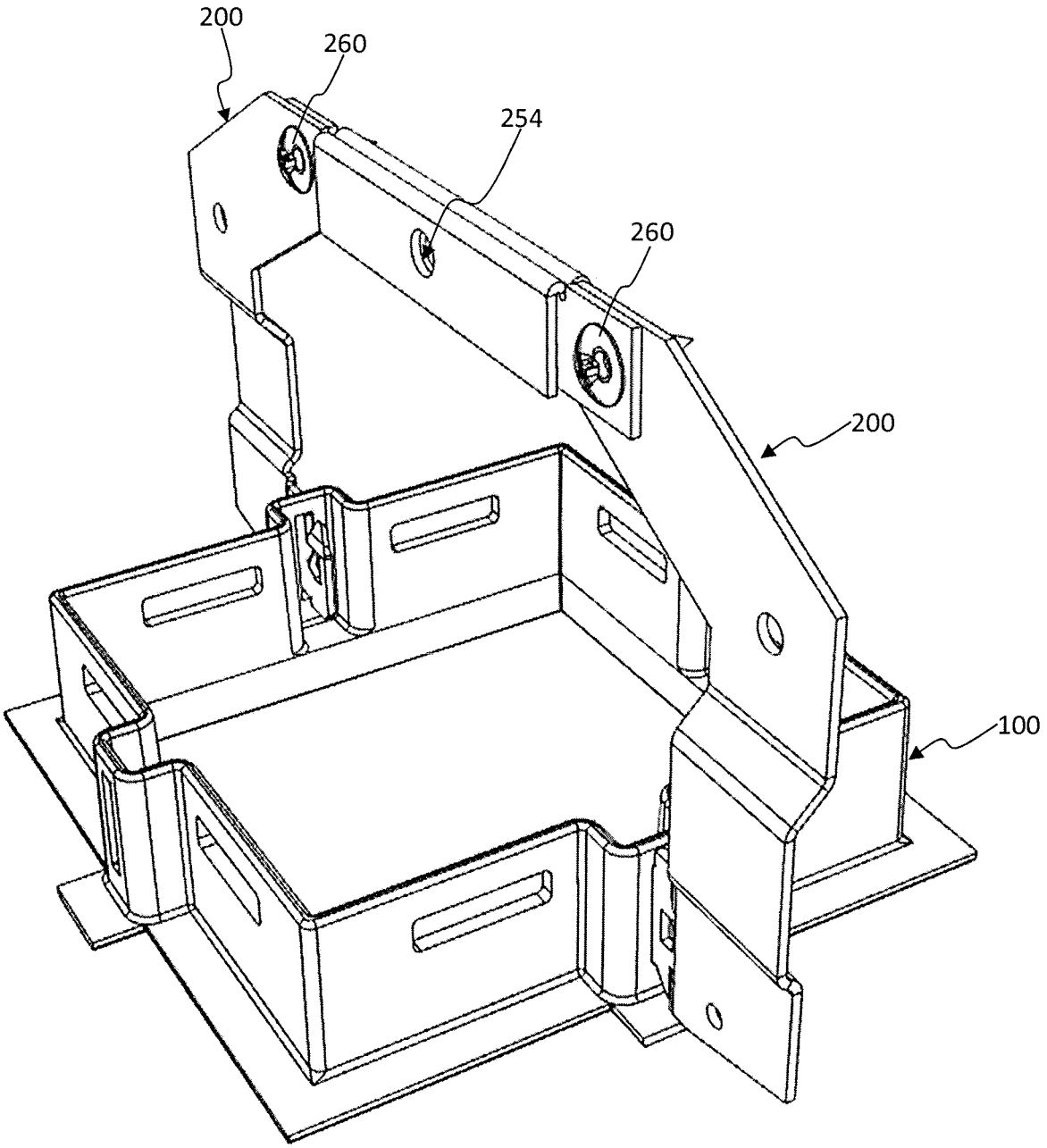
FIG. 3B is a perspective view of a pair of the yoke halves, according to an embodiment of the invention, inserted into the lighting hub of FIGS. 1A and 1B, according to an embodiment of the invention.

Referring to FIGS. 3A and 3B, a pair of yoke halves 200 are used to connect a first pair of ceiling beams (described in more detail below) to the lighting hub 100 and provide a point for connecting the lighting hub 100 to a structural support (not shown) by first inserting the leading edge 212 of each yoke half 200 into an opposing vertical slot 106 of the lighting hub 100. The notch 216 fits over the bottom of the vertical slot 106 and the upper flange 214 fits over the side of the vertical slot 106 to hold the connector portion 210 in place during installation. The stop 218 prevents the connector portion 210 from being inserted too far into the lighting hub 100. Because of the offset portion 104, the connector portion 210 does not extend past the interior 120 defined by the vertical walls 102. Once each yoke half 200 is inserted into the respective vertical slot 106, the two yoke halves 200 are joined by inserting fastening elements 260 such as screws through the aligned joint holes 252. The hanger holes 254 of the yoke halves 200 are aligned approximately over the center of the lighting hub 100. To support the lighting hub 100, a hanger wire (not shown) may be inserted through the hanger holes 254 and secured to a structural support (not shown) above the lighting hub 100.

Figure 3C:
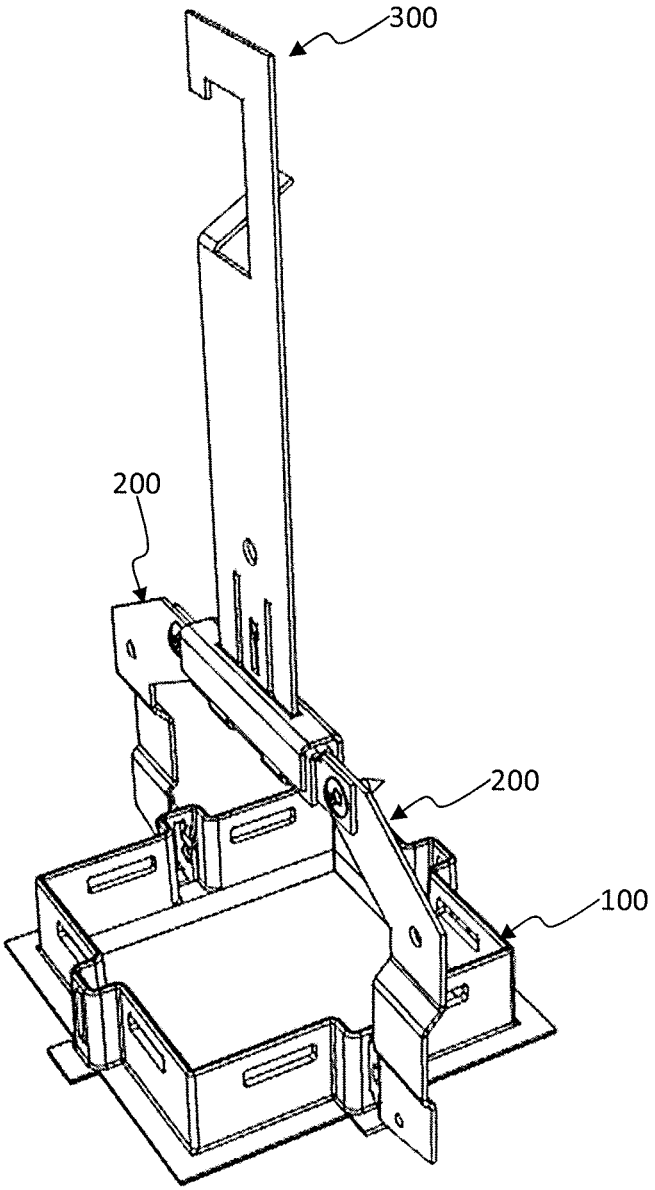
FIG. 3C is a perspective view of a Channel Beam Splice (CBS) hanger attached to the installed yoke halves of FIG. 3B, according to an embodiment of the invention.

Referring to FIG. 3C, a channel beam splice (CBS) hanger 300 may be attached to the joined yoke halves 200 after the yoke halves 200 are installed in the lighting hub 100. The CBS hanger 300 may be required in some jurisdictions which do not permit hang wires. The CBS hanger 300 further secures the two yoke halves 200 together and provides an attachment point to a structural support (not shown).

Figure 4A:
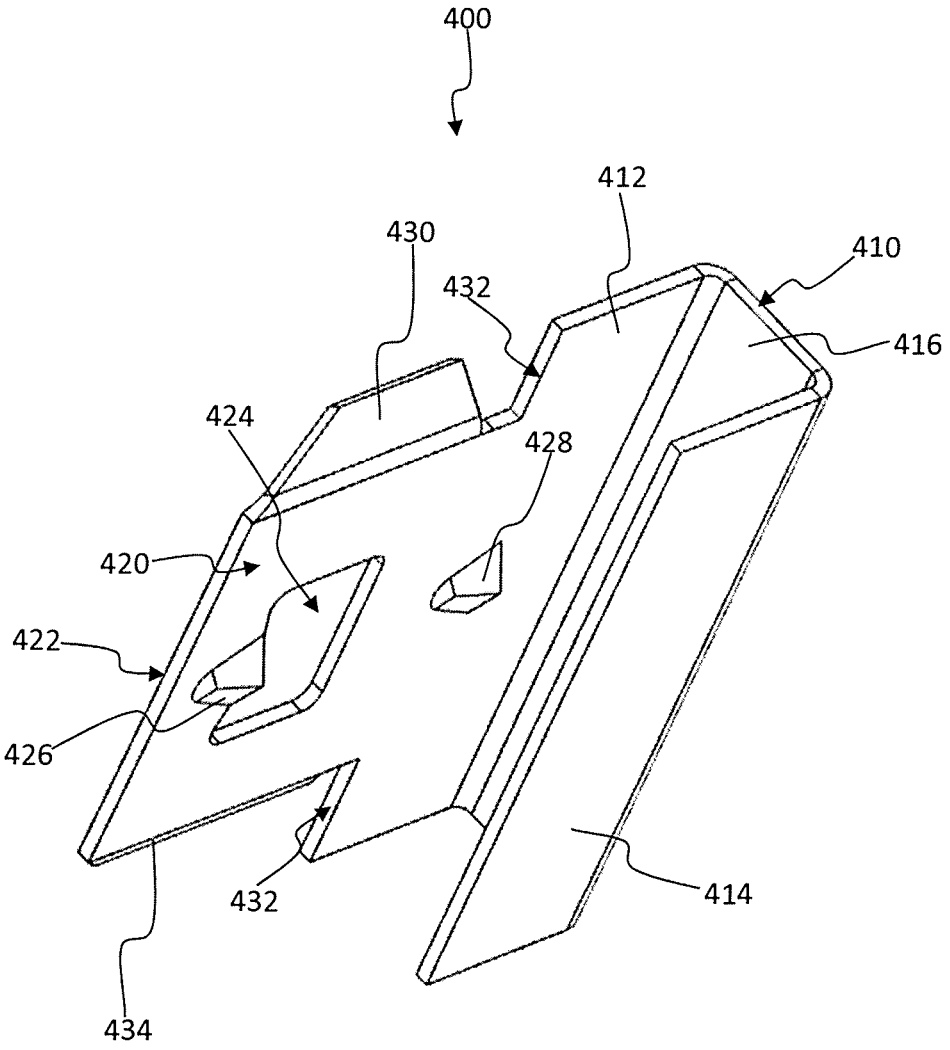
FIG. 4A is a perspective view of a clip adapter, according to an embodiment of the present invention.
Figure 4B:
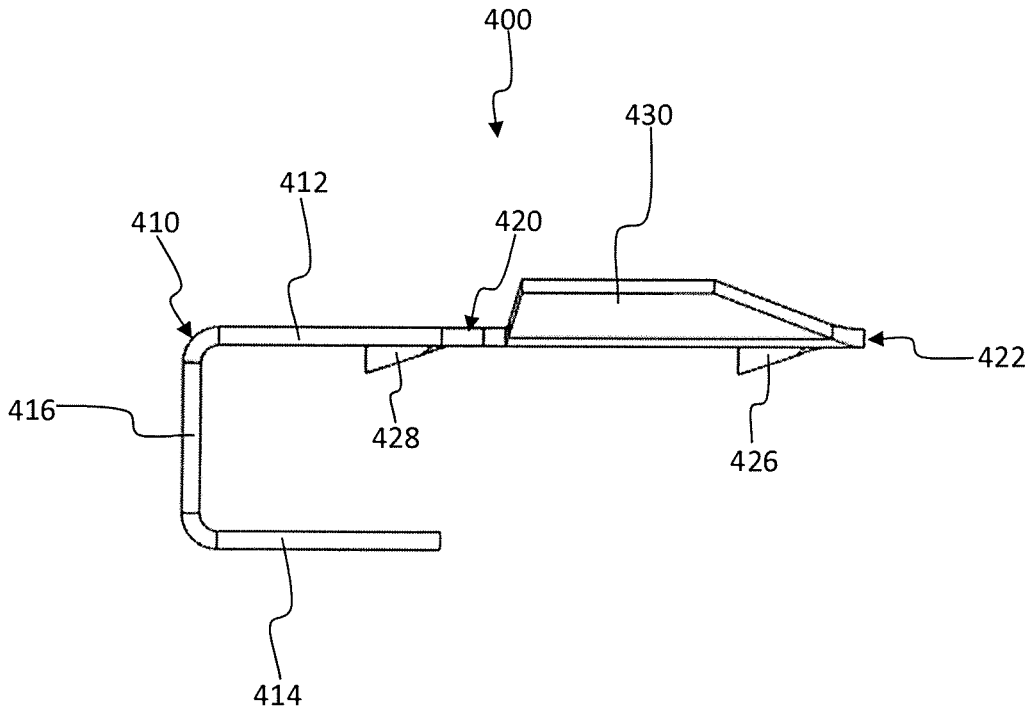
FIG. 4B is a side view of the clip adapter illustrated in FIG. 4A.

Referring to FIGS. 4A and 4B, a clip adapter 400 is provided according to an embodiment of the present invention. The clip adapter 400 includes a U-shaped channel 410 defined by a first wall 412, a second wall 414 parallel or substantially parallel to the first wall 412, and a third wall 416 which joins the first wall 412 and the second wall 414. The clip adapter 400 further includes an arm 420 which is attached to, and extends parallel to, the first wall 412. The arm 420 is narrower than the channel 410 such that a stop 432 is present on each side of the arm 420. The arm 420 includes a hole 424 and a leading protrusion 426 adjacent to the hole 424 nearer to a leading edge 422 of the arm 420 and a trailing protrusion 428 farther from the leading edge 422.

The leading protrusion 426 and the trailing protrusion 428 open away from the leading edge 422 and extend toward the second wall 414. The arm 420 further includes a top angled flange 430 and/or a bottom angled flange 434 which each extend outward away from the second wall 414.

Figure 5:
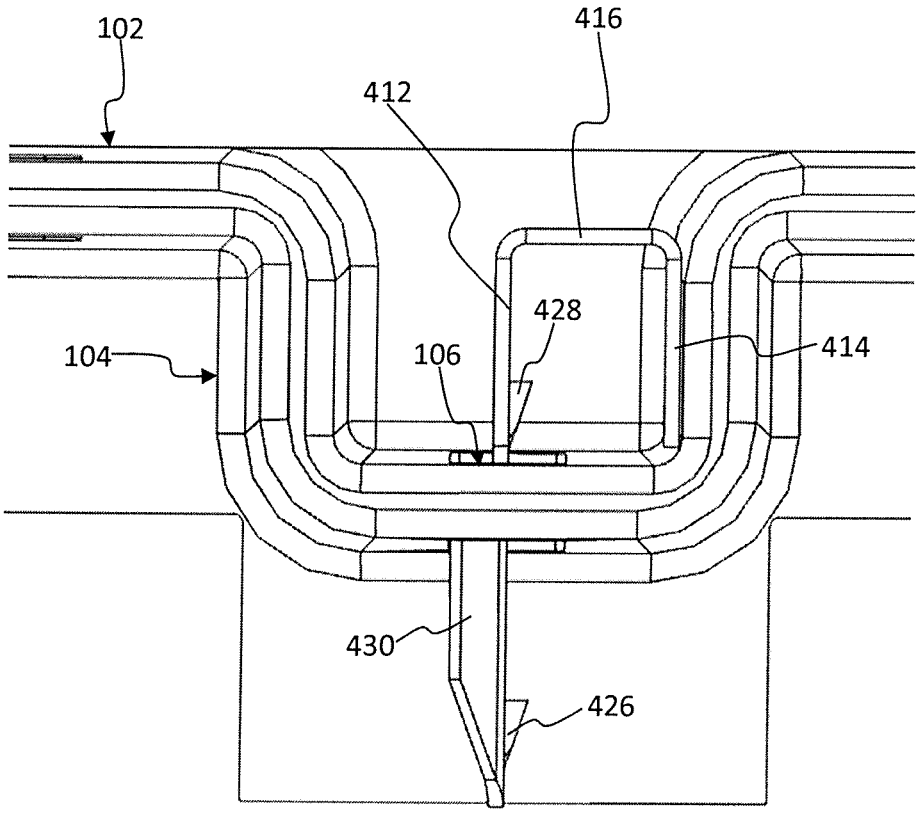
FIG. 5 is a top view of the clip adapter of FIGS. 2A and 2B inserted into the lighting hub of FIGS. 1A and 1B, according to an embodiment of the invention.

Referring to FIG. 5, a pair of the clip adapters 400 are used to connect a second pair of ceiling beams (described in more detail below) to the lighting hub 100 by first inserting the leading edge 422 of each clip adapter 400 into an opposing vertical slot 106 of the lighting hub 100. In contrast to the yoke halves 200, the clip adapters 400 are inserted into the vertical slot 106 from the interior 120 of the lighting hub 110. the clip adapters 400 are inserted into the vertical slot 106 until the stops 432 contact the interior of the offset portion 104. The channel 410 prevents the clip adapter 400 from being pulled through the vertical slot 106 and the top angled flange 430 and the bottom angled flange 434 limit rotation of the arm 420 in the vertical slot 106.

Figure 6:
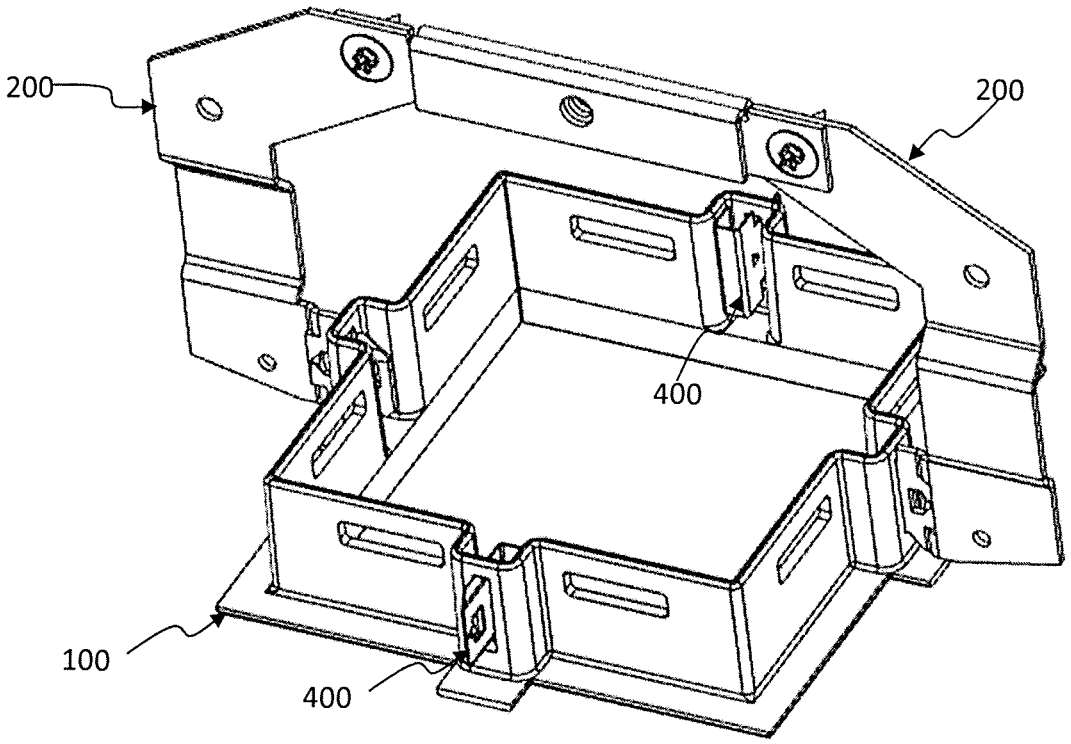
FIG. 6 is a perspective view of a pair of the clip adapters of FIGS. 4A and 4B and a pair of the yoke halves of FIGS. 2A and 2B inserted into the lighting hub of FIGS. 1A and 1B, according to an embodiment of the invention.

Referring to FIG. 6, the lighting hub 100 is depicted with the pair of opposing clip adapters 400 and opposing yoke halves 200 installed in the lighting hub 100.

Figure 7A:
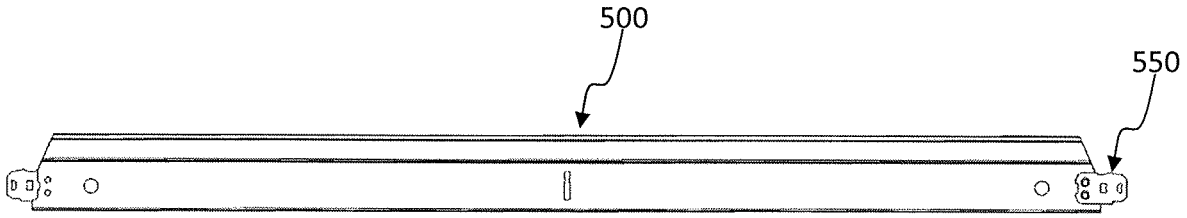
FIG. 7A is a side view of a ceiling beam having an attachment clip, according to an embodiment of the invention.
Figure 7B:
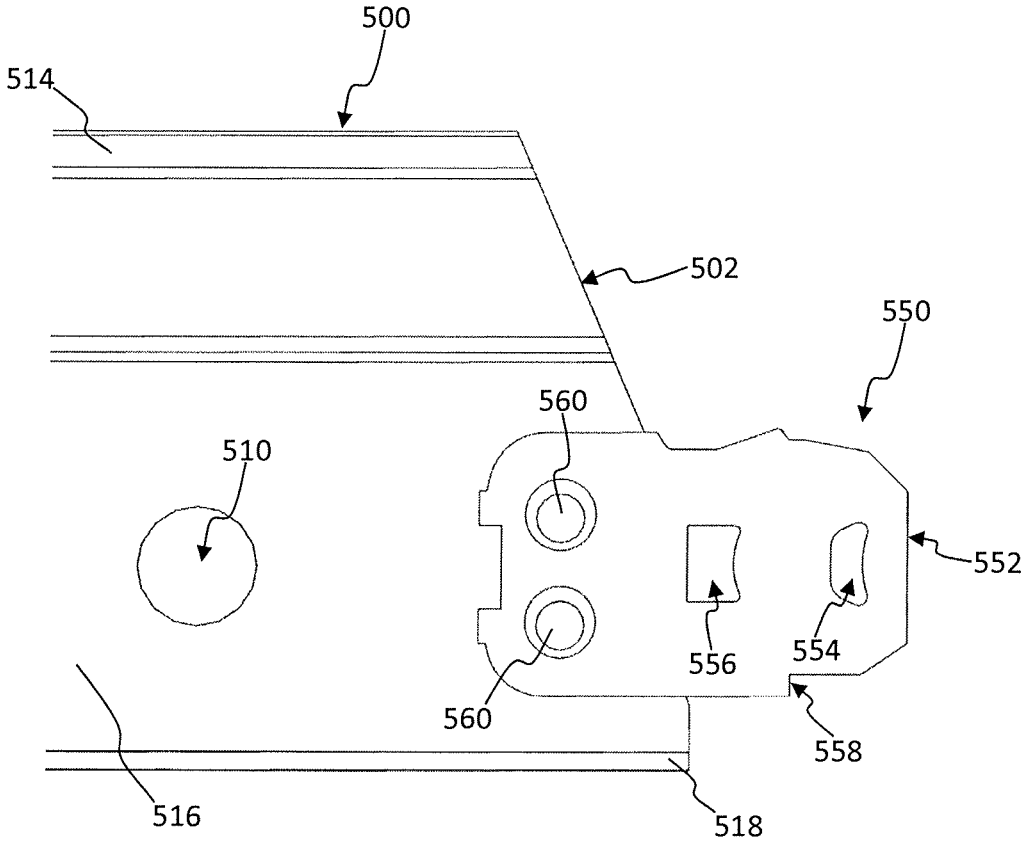
FIG. 7B is a side view of the attachment clip of FIG. 7A, according to an embodiment of the invention.

Referring to FIGS. 7A and 7B, a ceiling beam 500 having a connector clip 550 attached to an end 502 is provided according to an embodiment of the present invention. The ceiling beam 500 includes a bulb 514, a downwardly extending web 516, and a horizontal flange 518 at the bottom of the web 516. The connector clip 550 may be attached to the ceiling beam 500 with one or more fasteners 560. The connector clip 550 includes at least two holes: a leading hole 554 closer to the leading edge 552 of the connector clip 550 and a trailing hole 556 which is farther from the leading edge 552 of the connector clip 550. Suitable connector clips 550 are disclosed in U.S. Pat. Nos. 5,839,246 and 6,178,712, incorporated herein by reference. The ceiling beam 500 may also include a hole 510 adjacent to the connector clip 550. As disclosed in the '246 and '712 patents, for example, the connector clip 550 is typically used to join two adjacent cross beams each having an identical connector clip 550. The identical connector clips 550 are inserted through a slot in a main beam, where they snap together to form a connection. In order to form the opening for a light fixture, however, the connector clips 550 instead engage with one of the yoke halves 200 or a clip adapter 400 to form a secure connection to the lighting hub 100.

Figure 8:
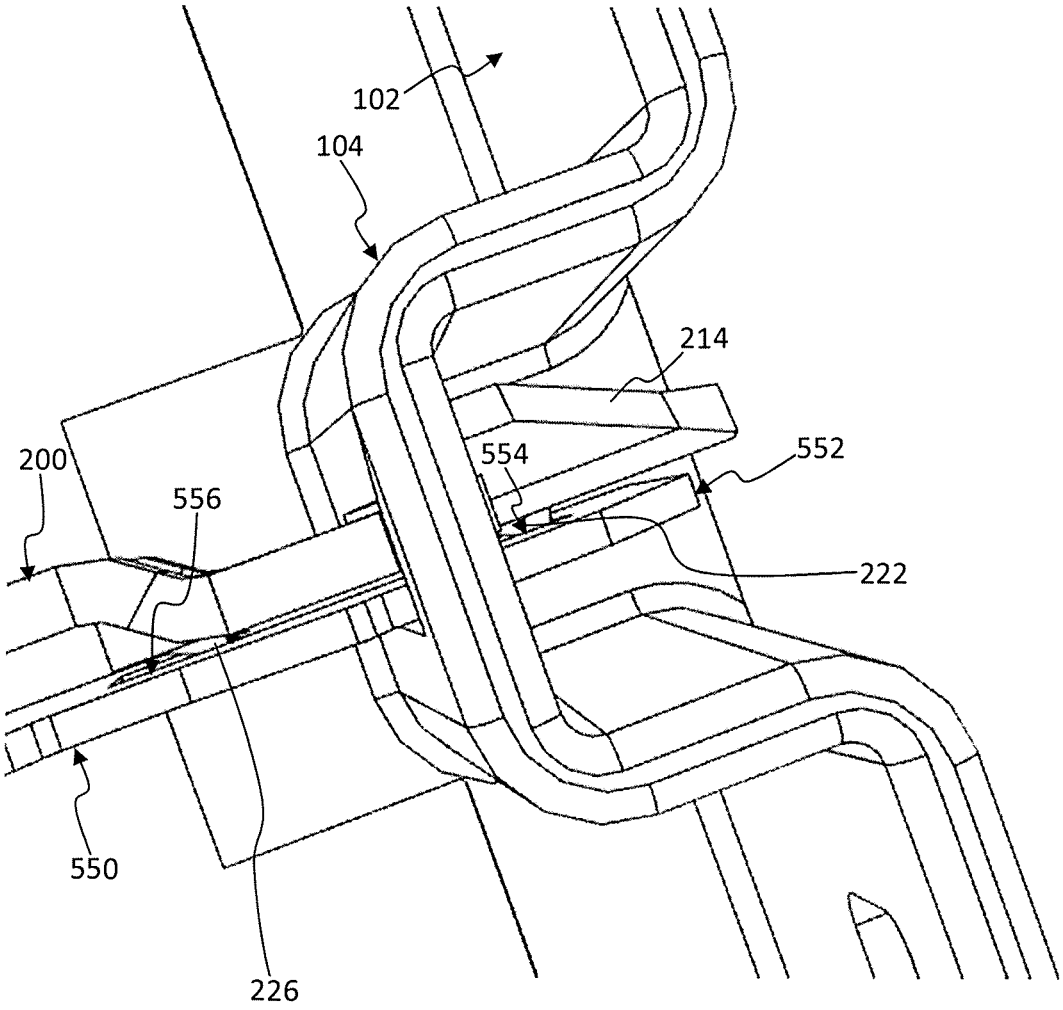
FIG. 8 is a perspective view of the attachment clip of FIG. 7B engaging with the yoke half of FIGS. 2A and 2B in the lighting hub of FIGS. 1A and 1B, according to an embodiment of the invention.

Referring to FIG. 8, to engage the connector clip 550 with the yoke half 200, the leading edge 552 of the connector clip 550 is inserted into the vertical slot 106 adjacent to the connector portion 210 of the yoke half 200. The connector clip 550 is positioned such that the upper flange 214 is angled away from the connector clip 550. Once the connector clip 500 is inserted into the vertical slot 106, the connector clip 550 engages with the connector portion 210 to prevent the connector clip 550 from being pulled back out of the vertical slot 106. The connector clip 550 enters the vertical slot 106 until the stop 558 reaches the bottom of the vertical slot 106. The stop 558 prevents the connector clip 550 from further entering the vertical slot 106. At approximately the same time, the leading protrusion 222 and the trailing protrusion 226 of the connector portion 210 engage with the trailing hole 556 and the leading hole 554 of the connector clip 550, respectively, thereby locking the connector clip 550 and the ceiling beam 500 in place.

Figure 9:
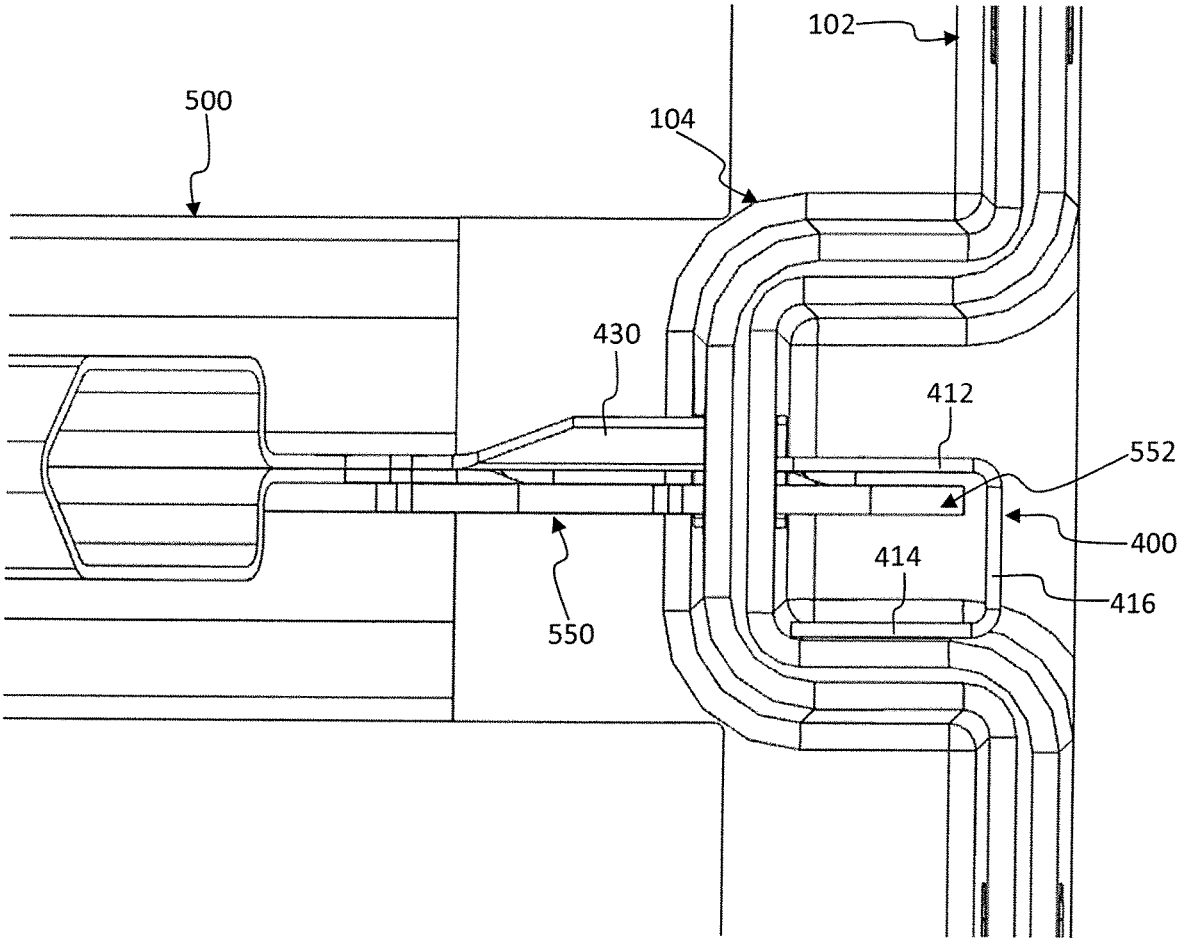
FIG. 9 is a top view of the attachment clip of FIG. 7B engaging with the clip adapter of FIGS. 4A and 4B in the lighting hub of FIGS. 1A and 1B, according to an embodiment of the invention.

Referring to FIG. 9, to engage the connector clip 550 with the clip adapter 400, the leading edge 552 of the connector clip 550 is inserted into the vertical slot 106 adjacent to the arm 420 of the clip adapter 400. The clip adapter 400 is positioned such that the top angled flange 430 and the bottom angled flange 434 of the clip adapter 400 are angled away from the connector clip 550 such that the top angled flange 430 and the bottom angled flange 434 fill the vertical slot 106 and prevent the clip adapter 400 and connector clip 550 from separating. Once the connector clip 550 is inserted into the vertical slot 106, the connector clip 550 engages with the arm 420 to prevent the connector clip 550 from being pulled back out of the vertical slot 106. The connector clip 550 enters the vertical slot 106 until the stop 558 reaches the bottom of the vertical slot 106. The stop 558 prevents the connector clip 550 from further entering the vertical slot 106. At approximately the same time, the leading protrusion 426 and the trailing protrusion 428 of the arm 420 engage with the trailing hole 556 and the leading hole 554 of the connector clip 550, respectively, thereby locking the connector clip 550 and the ceiling beam 500 in place.

Figure 10:
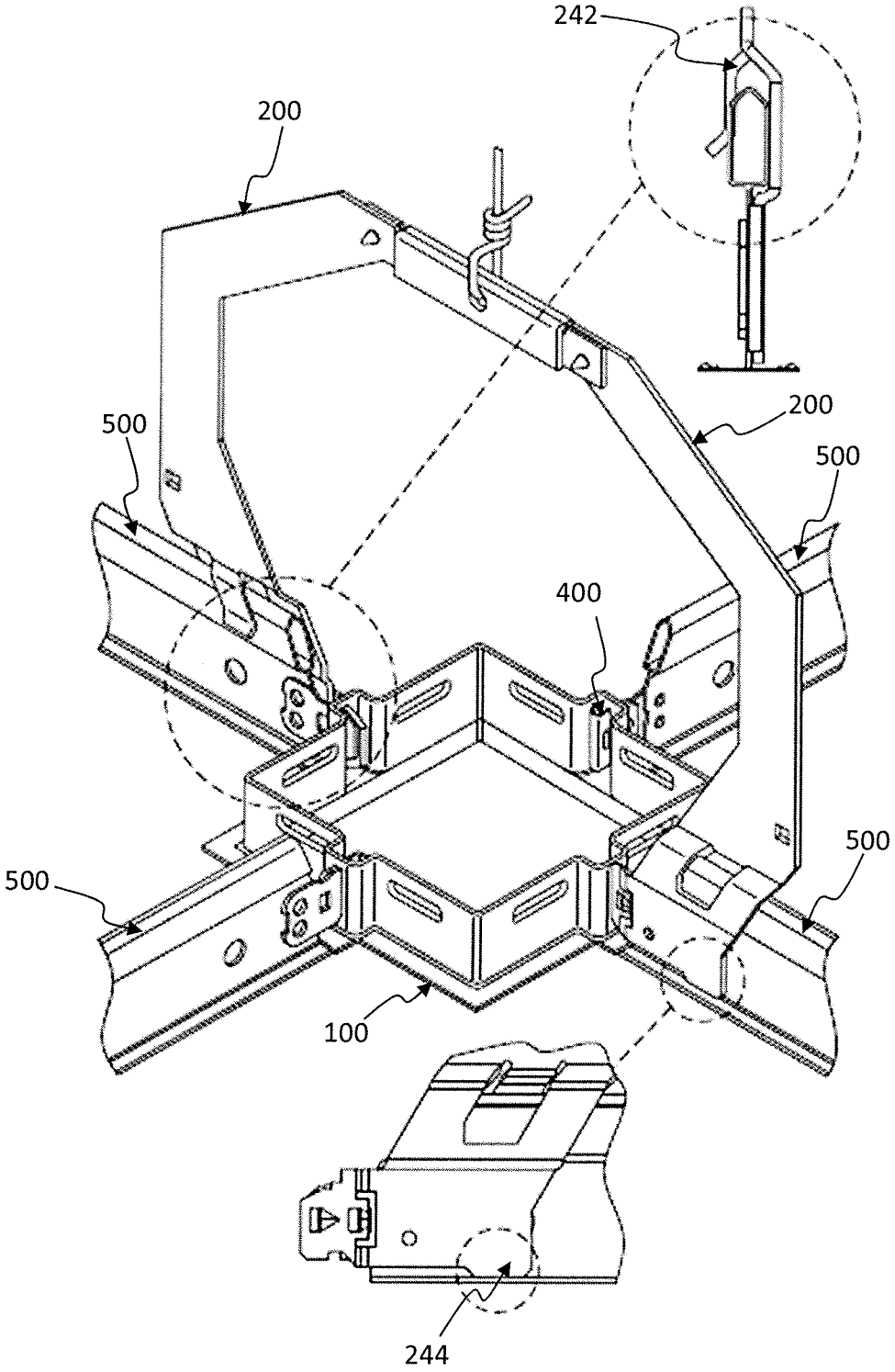
FIG. 10 is a perspective view of ceiling beams installed in the lighting hub of FIGS. 1A and 1B, according to an embodiment of the invention.

Referring to FIG. 10, the lighting hub 100 is depicted with the pair of opposing clip adapters 400 and opposing yoke halves 200 installed in the lighting hub 100, and ceiling beams 500 attached to each of the opposing clip adapters 400 and opposing yoke halves 200.

Figure 11:
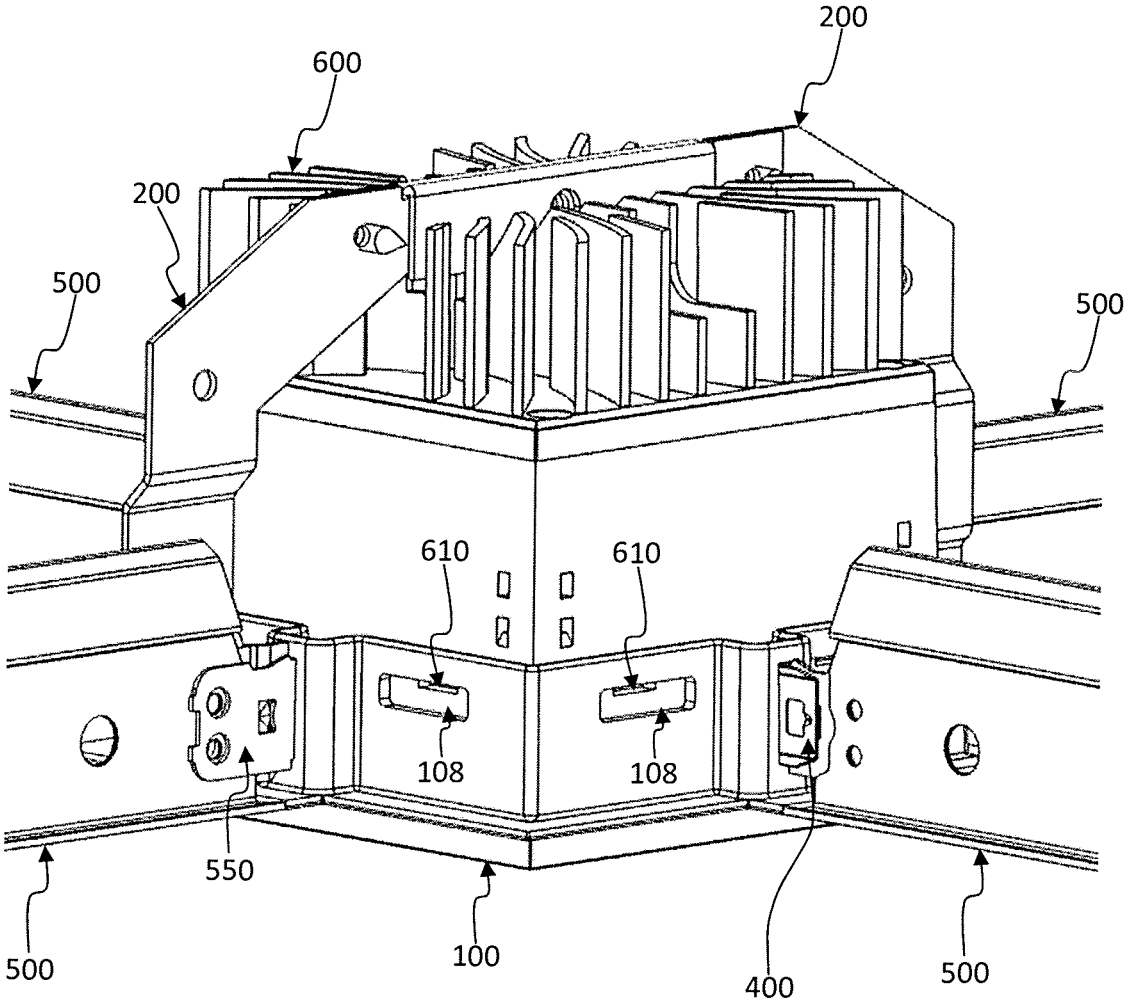
FIG. 11 is a perspective view of a light fixture installed in the lighting hub of FIGS. 1A and 1B, according to an embodiment of the invention.

Referring to FIG. 11, a light fixture 600 may be installed in the lighting hub 100 by inserting the light fixture 600 into the interior 120 of the lighting hub 100 from below until clips 610 of the light fixture 600 engage with the plurality of light attachment apertures 108. The light fixture 600 is preferably sized to fit below the yoke halves 200. Any suitable light fixture 600 may be used which has the necessary dimensions to fit below the yoke halves 200 with the clips 610 aligned with the light attachment apertures 108.

Figure 12:
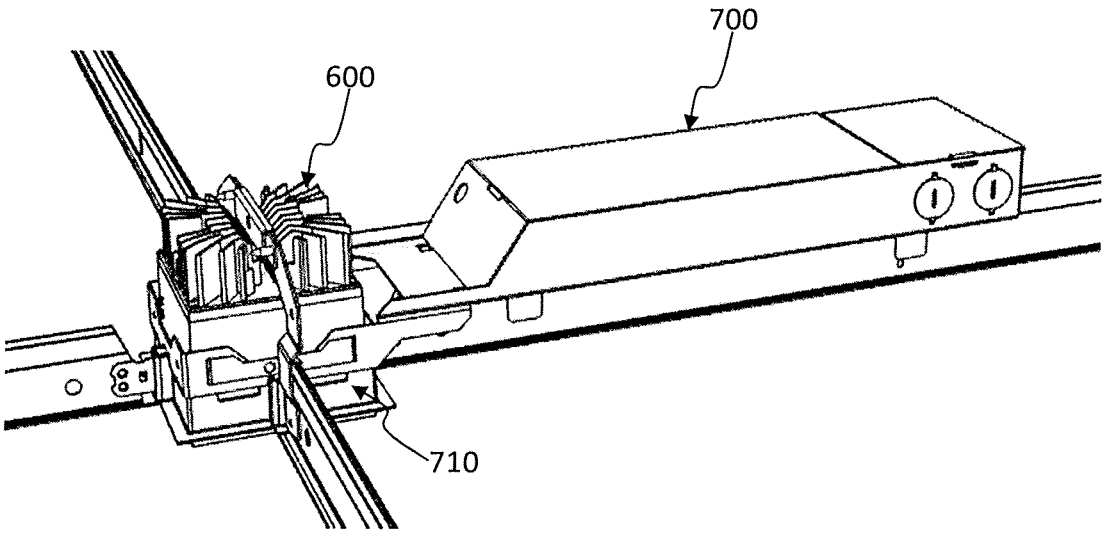
FIG. 12 is a perspective view of an electrical driver installed in the lighting hub of FIGS. 1A and 1B, according to an embodiment of the invention.

The lighting hub 100 may also include suitable connectors for other electrical components. For example, as depicted in FIG. 12, an electrical driver 700 for light emitting diode (LED) lighting may be included. The electrical driver 700 includes a collar 710 which slots over the lighting hub 100 and attaches to the lighting hub 100 by clipping into the light attachment apertures 108. The electrical driver 700 is preferably connected to the lighting hub 100 before installing the light fixture 600. In some embodiments, rather than clipping into the lighting hub 100, the light fixture 600 may instead attach to the electrical driver 700.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention.

What is claimed is:

1. A hub for installing a lighting fixture at the intersection of beams comprising:

connected walls defining an interior space, each wall including a wall surface with an outwardly projected wall protuberance having a first aperture and at least one second aperture within the wall surface; and a yoke including:

(a) a middle section that joins two vertical side sections, (b) the two vertical side sections each having;

a front face and opposite rear face, a louver element located on the front or rear face of the vertical side section, wherein the louver elements are located on opposite faces of the two vertical side sections, and a bottom edge connected to an inner vertical edge and a protruding edge projecting downward from the bottom edge, the protruding edge further connected to an opposite outer vertical edge, and (c) two connector sections, each connector section, projecting from inner vertical edges of the two vertical side sections, each connector section having a connector face containing at least one yoke protrusion, a connector leading edge projecting from each inner vertical edges of the two vertical side sections, the connector leading edge and inner vertical edge both connected to a top connector edge and opposite bottom connector edge wherein the top connector edge is closer to the middle section than the bottom connector edge, the top connector edge having a yoke stop, and the bottom connector edge having a notch;

wherein the yoke is releaseably connected to the walls by the connector leading edge passing through the first apertures of walls opposite one another; and an adapter clip including:

(a) a first clip wall, (b) a second clip wall parallel or substantially parallel to the first clip wall, (c) a third clip wall that joins the first clip wall and the second clip wall defining a u-shaped channel, and (d) a clip arm connected and parallel to the first clip wall, the clip arm having a leading clip edge opposite the edge connected to the first clip wall, at least one clip stop, at least one clip hole, at least one clip protrusion, and at least one clip flange, wherein the adapter clip is releaseably connected to the remaining walls not releaseably connected to the yoke by the leading clip edge passing through the first apertures of the remaining walls.

2. The hub of claim 1, wherein the first aperture and second aperture comprise slots and are located on different planes; the outwardly projected wall protuberances are located at the center or substantially the center of the walls; and the walls further comprise a first flange connected to one of the walls at a wall edge, the first flange projecting outwardly from the interior space, and a second flange connected to the first flange at an edge of the first flange opposite the wall edge, the second flange angularly projecting from the first flange.

3. The hub of claim 2, wherein the first flange projects from the wall at a perpendicular or substantially perpendicular angle and the second flange projects from the first flange at a perpendicular or substantially perpendicular angle.

4. The hub of claim 1, wherein the middle section of the yoke has at least one hanger hole and at least one of the middle section or the vertical side sections of the yoke is curved or bent.

5. The hub of claim 1, wherein at least one connector section of the yoke is connected to the vertical side section of the yoke by an offset section whereby the connector section and the vertical side section of the yoke are on different planes, and the connector section of the yoke further comprises at least one connecting aperture and a third aperture adapted to receive a fastener.

6. The hub of claim 5, wherein the at least one connector section of the two connector sections of the yoke further comprises two connecting apertures defining slots and two yoke protrusions that open towards the connector leading edge.

7. The hub of claim 1, wherein the yoke is further comprised of two half-yokes, each half-yoke including one of the two vertical side sections;

one of the two connector sections; and a yoke-arm section defining a portion of the middle section, the yoke-arm section including at least one joining aperture, whereby the two yoke-halves are configured to be releaseably connected to form the yoke by passing at least one fastener through the joining apertures of the half-yokes thereby forming the middle section.

8. The hub of claim 1, further comprising a beam including a beam clip connected to an edge of the beam, the beam clip having a leading beam edge opposite the section edge of the beam, at least one beam aperture, and at least one beam stop, wherein the beam is releaseably connected to the walls by the leading beam edge passing through the first aperture of the wall so the beam clip is adjacent to the connector section and the beam aperture releaseably engages with the at least one yoke protrusion.

9. The hub of claim 8, wherein the beam further comprises at least one bulb connected by a web to at least two beam flanges extending opposite from one another, the beam clip further comprises two beam apertures of the at least one beam aperture, and the connector sections further comprise two yoke protrusions.

10. The hub of claim 1, further comprising a light fixture attached to the walls by fasteners passed through sections of the light fixture and the second apertures.

11. The hub of claim 1, further comprising a beam including a beam clip connected to an edge of the beam, the beam clip having a leading beam edge opposite the edge of the beam; at least one beam aperture, and at least one beam stop, wherein the beam is releaseably connected to the walls either:

by the leading beam edge passing through the first aperture of the wall so the beam clip is adjacent to the connector section and the beam aperture releaseably engages with the at least one yoke protrusion, or by the leading beam edge passing through the first aperture of the wall so the beam clip is adjacent to the clip arm and the beam aperture releaseably engages with the clip protrusion.

12. The hub of claim 1, further comprising a light fixture attached to the walls by fasteners passed through the light fixture and the second apertures.

* * * * *